United States Patent [19]

Strickland

[11] Patent Number: 4,784,370

[45] Date of Patent: Nov. 15, 1988

[54] STAPLE REMOVING DEVICE AND ASSOCIATED METHOD

[76] Inventor: Larry D. Strickland, 103 Holly La., Morgantown, W. Va. 26505

[21] Appl. No.: 81,468

[22] Filed: Aug. 4, 1987

[51] Int. Cl.[4] ..... B25C 11/00

[52] U.S. Cl. ..... 254/28

[58] Field of Search ..... 254/28, 18; 7/125, 165, 7/166

[56] References Cited

U.S. PATENT DOCUMENTS 3,311,346 3/1967 Almond ..... 254/28

3,494,591 2/1970 Fleming ..... 254/28

4,487,394 12/1984 Rothfuss et al. ..... 254/28

*Primary Examiner*—Robert C. Watson

*Attorney, Agent, or Firm*—Arnold B. Silverman

[57] ABSTRACT

A staple removing device and associated method employing unique clamping devices for the removal of a staple that is broken or partially inserted in an object. The clamping devices are provided to engage the whole or parts of a partially removed staple thereby allowing the staple to be pulled from the object in accordance with the associated method.

21 Claims, 5 Drawing Sheets

STAPLE REMOVING DEVICE AND ASSOCIATED METHOD

BACKGROUND OF THE INVENTION

1. Field of the Invention

This invention relates to an apparatus and associated method for removing a staple from an object and, more specifically, it relates to a staple removing device that includes a unique clamp that is capable of engaging and removing a staple or broken segment of a staple that is only partially inserted in or removed from an object.

2. Description of the Prior Art

A number of devices have been proposed for removing staples from objects.

U.S. Pat. No. 2,033,050 discloses a tool for removing staples that incorporates a pair of generally wedge-shaped cooperating staple engaging teeth that are normally biased apart. When it is desired to remove a staple, the teeth are positioned below the crossbar of the staple and the jaws of the tool are then squeezed together forcing the teeth under the staple. The staple is then pulled away from the object in which it is inserted. This device is designed to remove staples that have both, and not just one, of their prongs inserted in the object.

U.S. Pat. No. 2,940,727 discloses a staple remover that incorporates a metal strip disposed between two teeth of the device. The metal strip is used to dislodge staples that may become engaged around the teeth of the staple remover. This device, likewise, is designed to remove staples that have both, and not just one, of their prongs inserted in the object.

U.S. Pat. Nos. 3,143,800 and 3,630,486 each disclose destapling devices that have been modified to engage staples that have been partially inserted or removed from an object. Each has a pair of grooves or notches formed in their upper and lower halves such that, when the destapling tool is biased in its normally open position, the notches of the upper half are adjacent to the notches of the lower half forming a pair of cooperating openings. When the forward portions of the stapling tool are squeezed together, the notches of the upper portion move out of alignment from the notches of the lower portion thereby squeezing and engaging a staple that is inserted within the cooperating openings. As the notches are rather narrow, careful alignment between the notches and staple is required for effective operation of this device.

Despite the above-described devices, there exists a real need for an easy to use staple remover that is capable of removing staples and broken segments thereof that have either both or only one prong inserted, or partially inserted, in an object.

SUMMARY OF THE INVENTION

The present invention has met the above described need. The present invention preferably includes pivotally connected first and second members. Four projecting teeth, two on the first member and two on the second member, cooperate like typical staple removers sold on the market today, whereby, when they are moved toward each other, they surround the crossbar of a staple thereby allowing the staple to be pulled from the object into which it is inserted. However, as frequently occurs, one prong of the staple may resist removal from the object, even though the other prong becomes disengaged or the staple may in fact break leaving two protruding wires. When this occurs, the cooperating teeth of the staple remover provide little further assistance in removing the other staple prong or protruding pieces from the object as the teeth cannot effectively clamp the partially removed staple or staple pieces. In the preferred embodiment of the invention, a pair of pivotally engaged clamps, one on the first member and one on the second member, are also included and are provided to engage partially removed and protruding pieces of staples.

The present invention, therefore, provides two distinct devices, for the removal of either a fully inserted, partially inserted or broken staple, in one tool. With the present invention, after an unsuccessful attempt to remove the staple with the staple remover's teeth, the staple is positioned between the first and second members'clamping surfaces which are normally biased apart. The first and second members are then rotated toward each other, causing the staple to be squeezed between and engaged by the first and second members, clamping surfaces. The staple removing device is then pulled away from the object causing the staple to be removed from the object.

It is an object of the invention to provide a single staple remover tool that includes a device for removing fully inserted or broken staples from objects and another device for removing partially inserted staples from objects.

It is a further object of the invention to provide a staple remover and associated method for removing partially inserted staples from objects.

It is a further object of the invention to provide a staple remover and associated method that includes both pivotally connected cooperating teeth and pivotally connected clamps for the removal of staples from objects.

It is a further object of the invention to provide another embodiment wherein the staple remover has blocks disposed on the underside of the two members of the staple remover to provide another method of removing partially inserted staples from objects.

It is a further object of the invention to provide a staple remover that is inexpensive and simple to manufacture.

It is a further object of the invention to provide a method for removing staples that is easy to implement.

It is a further object of this invention to provide a method for removing broken segments of partially removed staples.

These and other objects of the invention will be more fully understood from the following description of the invention on reference to the illustrations appended hereto

DESCRIPTION OF THE PREFERRED EMBODIMENTS

The term "staple" as used herein, unless the specific use expressly indicates otherwise, shall refer to entire staples or portions (broken or partially inserted) thereof.

Figure 1:
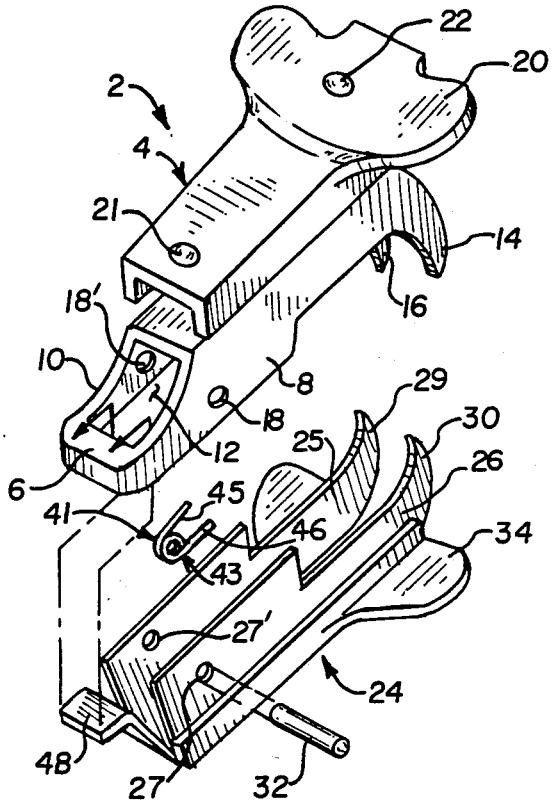
FIG. 1 is an exploded perspective view of a preferred form of my staple removing device.

FIG. 1 shows a staple remover 2 having two cooperating members which are preferably relatively pivotable. First member 4 is generally elongated and includes a rearwardly projecting first clamping element 6 which is formed between sidewalls 8 and 10. First clamping element 6 and sidewalls 8 and 10 define passageway 12. Sidewalls 8 and 10 have pointed forwardly disposed downwardly projecting generally parallel teeth 14 and 16 which, in the form shown, are generally wedge-shaped. Also included in first member 4 are generally aligned holes 18 and 18', which receive the pivot pin 32.

Also shown is cap 20 which provides a convenient finger or thumb surface. Cap 20 is preferably made of plastic and attached to first member 4 through rivets 21 and 22, although it could also be attached using a cooperating nut and bolt assembly or adhesives and the like.

Second member 24 is designed to cooperate with first member 4. The planes of sidewalls 25 and 26, of second member 24, are generally parallel and spaced apart so that they may cooperatively fit between sidewalls 8 and 10 of first member 4. The sidewall members 24, 25 have respective holes 27, 27' that are designed to align with holes 18, 18' of first member 4 when staple remover 2 is assembled. The sidewalls 25 and 26 have pointed forwardly disposed upwardly projecting generally parallel teeth 29, 30 which in the form shown are generally wedged shaped. The distance between sidewalls 25 and 26 of second member 24, and teeth 29 and 30, respectively, is generally slightly different from the respective distances between holes 18 and 18' of first member 4, and teeth 14 and 16, respectively in order to permit internesting when the teeth 14, 16 and teeth 29, 30 are moved to closed position (See FIG. 9).

Figure 8:
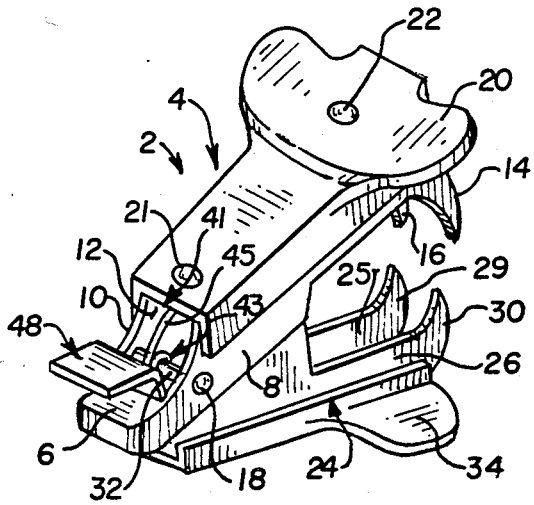
FIG. 8 is a perspective view of the assembled staple removing device of FIG. 1.

First member 4 and second member 24 are pivotably connected by pin 32. With this configuration, when first member 4 is pivotally connected to second member 24, through the use of pin 32, as shown in FIG. 8, teeth 14 and 16 cooperate with teeth 29 and 30. Second member 24 also has attached cap 34, which may be connected to second member 24 in the same manner as cap 20 is connected to first member 4.

It will be appreciated that except for the rear portions which will be described in greater detail hereinafter, the first member 4 and second member 24 may have substantially the same shape.

Also shown in FIG. 1 is biasing means 41 which, in the form shown, is a coil spring. It is also contemplated that biasing means 41 could be a resiliently compressible material, such as rubber or vinyl for example, or a flat metal spring member which would be interposed between members 4 and 24 to urge them apart. Opening 43 of spring-like biasing means 41 receives pin 32 for securing biasing means 41 in proper position. Leg 45 of biasing means 41 is in contact with first member 4 while leg 46 is in contact with second member 24 to urge those two members apart.

FIG. 1 also shows second clamping element 48 which projects out of passageway 12 to cooperate with first clamping element 6 when first member 4 is cooperatively engaged with second member 24. Clamping elements 6 and 48 each have generally planar cooperating surfaces that are generally parallel to each other when engaging a staple. These surfaces in the form shown are the upper surface of first clamping element 6 and the facing lower surface of second clamping element 48. Second clamping element 48 can be modified to function as the tip of a light duty screwdriver or a container lid remover, if desired.

Figure 2:
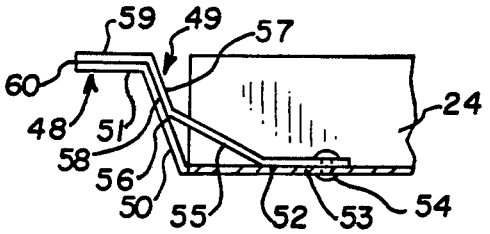
FIG. 2 is an enlarged side view of the clamping element of the invention showing a first embodiment of a stiffening element.

FIG. 2 shows an enlarged view of the second clamping element 48 with a preferred stiffening element 49. The second clamping element 48 can be integrally formed with the second member 24 or can be attached to the second member 24 as by welding, for example. Second clamping element 48 has a generally angularly disposed section 50 and a generally planar section 51. The stiffening element 49 has a generally horizontal section 52 that is in intimate surface-to-surface contact with the bottom surface 53 of second member 24. Horizontal section 52 is preferably attached to second member 24 by rivet 54, although it can be attached by other methods such as welding or adhesives. The stiffening element 51 has a generally angled section 55 that extends angularly upwardly away from bottom surface 53 of second member 24. The angled section 55 then engages the angled section 50 of second clamping element 48 at connection point 56. The stiffening element 51 has another generally angled section 57 that engages the inner surface 58 of the angled section 50. This angled section 57 is attached to the inner surface 58 of angled section 50 by adhesives or welding, for example. The stiffening element 51 has a generally horizontal section 59 that engages the top surface 60 of the horizontal section 51 of second clamping element 48.

Figure 3:
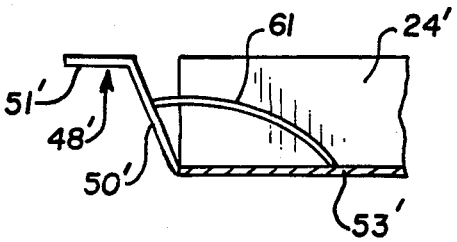
FIG. 3 is an enlarged partially broken away view of the clamping element of the invention showing a second embodiment of a stiffening element.
Figure 4:
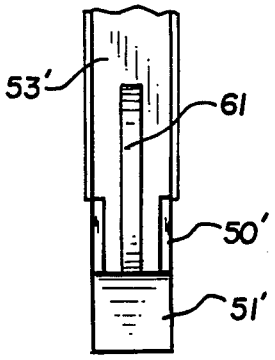
FIG. 4 a top view of the stiffening element shown in FIG. 3.

FIGS. 3 and 4 show another embodiment of a stiffening element 61. This stiffening element is integrally stamped from the angled section 50' of second clamping element 48' and from the bottom surface 53' of second member 24', as can best be seen in FIG. 4.

Figure 5:
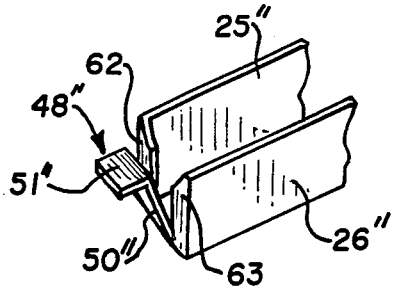
FIG. 5 is a perspective view of the clamping element of the invention showing a third embodiment of a stiffening element.
Figure 6:
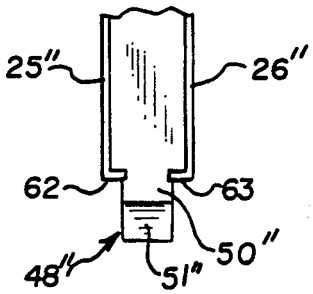
FIG. 6 is a top view of the stiffening element shown in FIG. 5.
Figure 7:
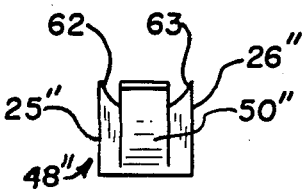
FIG. 7 is a front elevational view of the stiffening element shown in FIG. 5.

FIGS. 5–7 show another means for stiffening the second clamping element 48". In this form, tabs 62 and 63, are integrally formed with sidewall 25"and 26", respectively, engage the angled section 50" to provide the second clamping element 48" with greater support.

FIG. 8 shows the staple remover 2 in assembled form with first member 4 pivotally connected to second member 24. In this figure, staple remover 2 is shown in its normal open biased position. In this position, teeth 14 and 16 are separated from teeth 29 and 30, and second clamping element 48 is separated from first clamping element 6. Pin 32, which secures first member 4, second member 24 and biasing means 41 in position, may, for example, include enlarged portions at each end of its longitudinal axis, to resist disengagement from staple remover 2, or may take on the form of a cooperating nut and bolt (not shown) to resist such disengagement.

Figure 9:
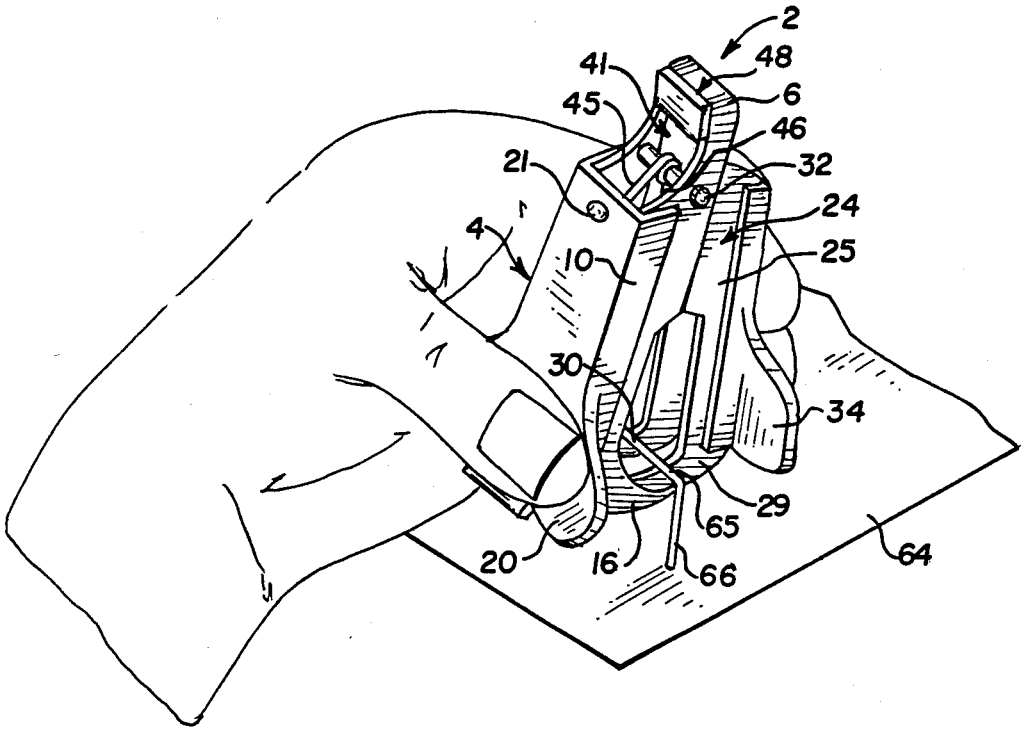
FIG. 9 is a perspective view of the staple removing device of FIG. 1 shown engaging a staple which has both prongs inserted in an object.
Figure 10:
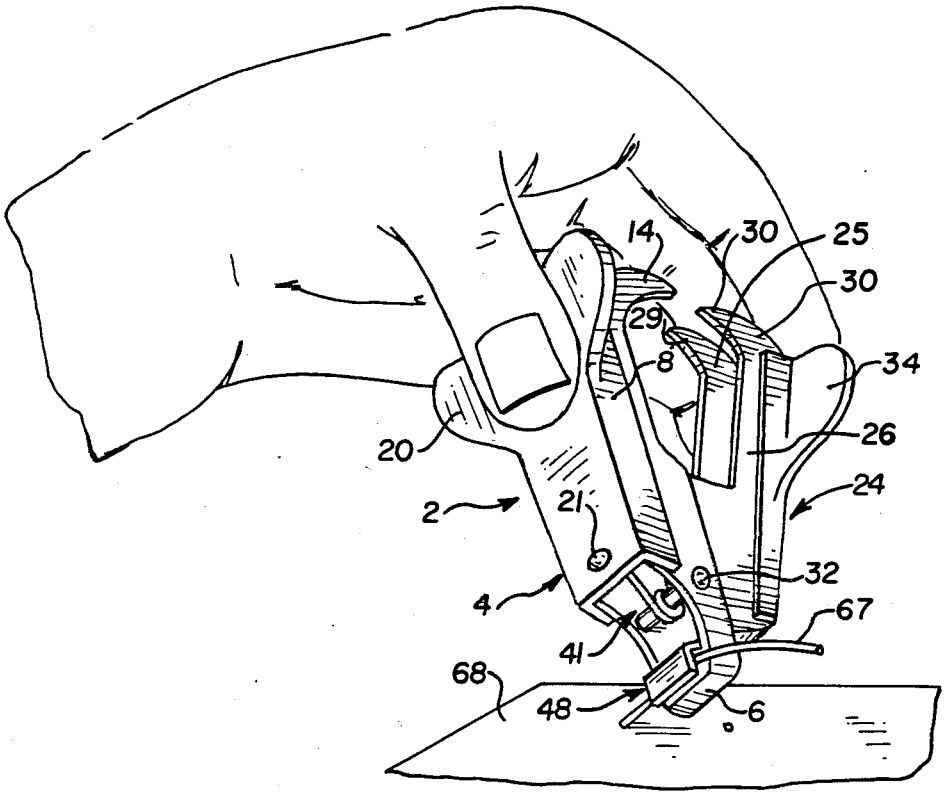
FIG. 10 is a perspective view of the staple removing device of FIG. 1 shown engaging a staple that has been only partially, removed from an object.

When it is desired to remove a staple from an object employing this embodiment of the invention, staple remover 2 is positioned as shown in FIG. 9. Teeth 14 and 16, and 29 and 30 are placed between object 64 and crossbar 65 of staple 66. First member 4 and second member 24 are then rotated about pin 32 to a closed position, and staple 66 is then pulled from object 64 by camming. If the staple is only partially removed from object, broken staple 67 or broken segments thereof are then positioned between clamping elements 6 and 48 as shown in FIG. 10. By rotating first member 4 toward second member 24, first clamping element 6 squeezes broken staple 67 against second clamping element 48. Staple remover 2, along with clamped broken staple 67, is then pulled away from object 68 causing staple 67 to be removed from object 68.

Figure 11:
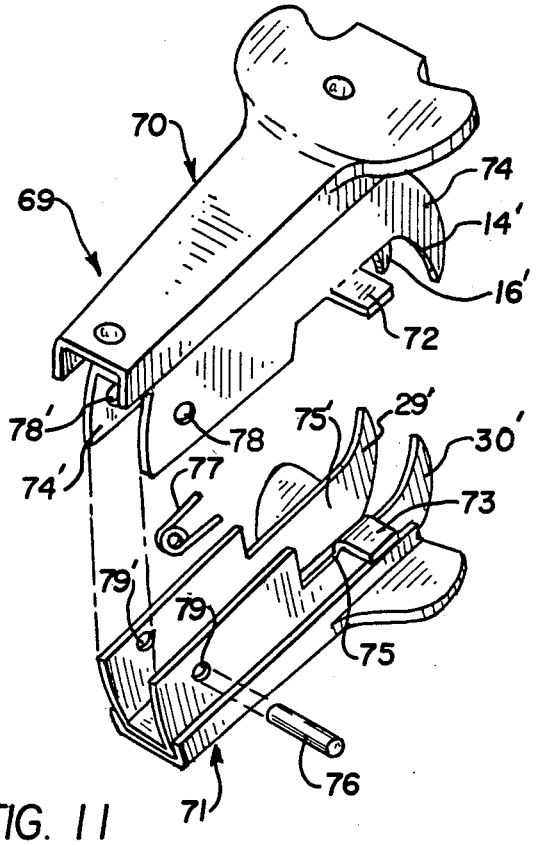
FIG. 11 is an exploded perspective view of another embodiment of the staple removing device.

FIG. 11 shows an alternate preferred embodiment of the staple remover. In this embodiment, staple remover 69 has first and second members 70 and 71, respectively, both of which have been modified to include transversely outwardly projecting clamping elements 72 and 73 having substantially planar surfaces. In this form of the invention, clamping elements 72 and 73 are generally rectangular pieces of metal, although other shapes may be employed. Preferably, clamping element 72 is integrally formed with sidewall 74 of member 70 while clamping element 73 is attached to sidewall 75 of member 71. Alternately, attachment of separate members to the members 70 and 71 may be employed. It is anticipated that clamping elements 72 and 73 be attached to sidewalls 74 and 75 through the use of solder, welds, glue and the like, or preferably can be formed as integral tabbed extensions of these same members.

The members 70 and 71 are pivotally secured to each other by pin 76 which is received through biasing means 77. The pin 76 is placed through holes 78 and 78' of first member 70 and holes 79 and 79' of second member 71. The clamping elements 72 and 73 should be positioned forwardly of biasing means 77 and sufficiently far rearward of the free ends of teeth 14',16' and 29',30' that the sidewalls 74, 74', 75, and 75' will have space to receive and store several removed staples.

Figure 12:
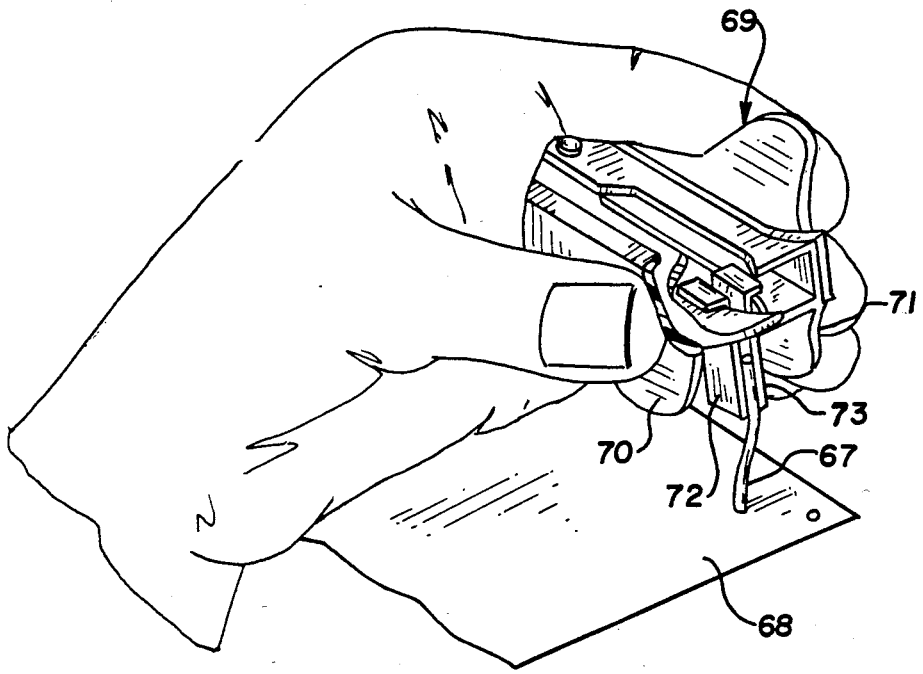
FIG. 12 is a perspective view of the staple removing device embodiment of FIG. 11 shown engaging a protruding piece of a staple that has not been removed from an object.

As shown in FIG. 12, in use, if staple 67 has been only partially removed from an object 68 and it is desired to effect complete removal thereof, then staple 67 is interposed between clamping elements 72 and 73. Members 70 and 71 of staple remover 69 are then rotated toward each other, clamping staple 67 between clamping elements 72 and 73. Staple remover 69 is then pulled away from object 68 causing staple 67 to be removed from object 68. Members 70 and 71 may then be opened to release staple 67.

It is to be understood that the unique clamping elements of the present invention may be secured to other parts of the staple remover and still provide effective clamping action for the removal of a partially inserted staple when the first and second members are relatively pivoted. For example, the clamping elements could be located near the teeth of the staple remover or at locations along the staple remover's longitudinal axis other than those shown. With such arrangements, the teeth of the staple remover would still first be used to attempt removal of the fully inserted staple. The clamping elements would next be used if the initial removal attempt were unsuccessful.

Figure 13:
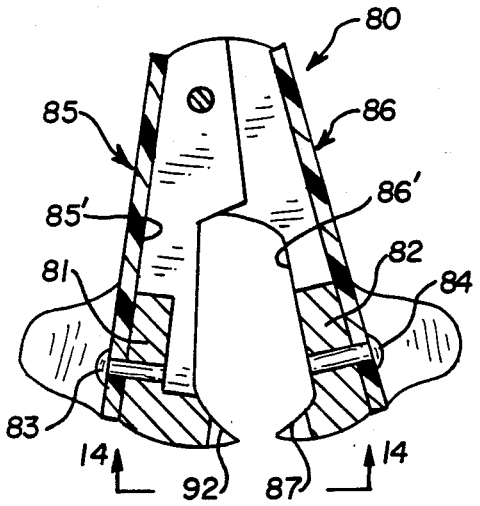
FIG. 13 is a partially broken-away front elevational view of still, another embodiment of the staple removing device.
Figure 14:
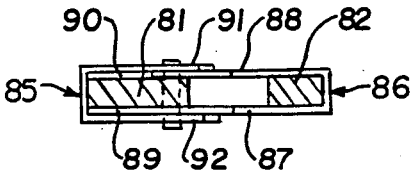
FIG. 14 is a cross-sectional view taken along line 14—14 of FIG. 13.

Another embodiment of the staple remover device 80 is shown in FIG. 13. Here, blocks 81 and 82, attached by rivets 83 and 84, respectively, are disposed on the underside 85', and 86', of members 85 and 86, respectively. This can best be seen in FIG. 14. Block 81 is sized so that the teeth 87 and 88 of member 86 may preferably effectively fit in the recesses 89 and 90 between block 81 and the teeth 91 and 92 of member 85. It can be appreciated that recesses 89 and 90 can be formed in the blocks 81 and 82 so that teeth 87 and 88 of member 86 may effectively operate.

Figure 15:
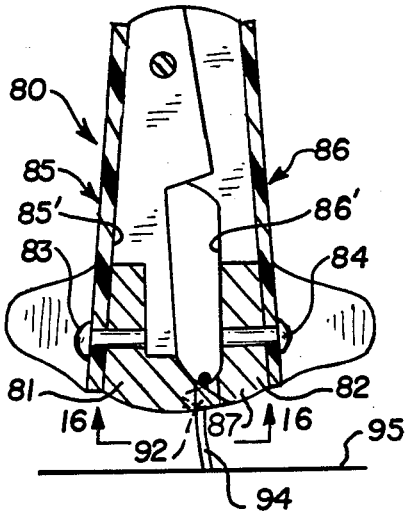
FIG. 15 is a partially broken away front elevational view of the staple removing device of FIG. 13 shown engaging a protruding piece of a staple that has not been removed from an object.
Figure 16:
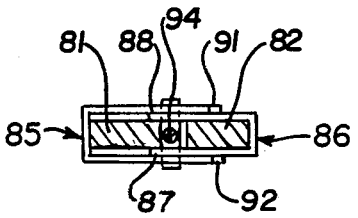
FIG. 16 is a cross-sectional view taken along line 16—16 of FIG. 15.

In use, as shown in FIG. 15, the staple remover device 80 is positioned so that broken staple 94 is disposed between blocks 81 and 82. The members 85 and 86 are urged together so that blocks 81 and 82 engage broken staple 94 as can best be seen in FIG. 16. The broken staple is then removed by pulling the staple remover 80 with the clamped broken staple 94 away from the object 95.

It can be appreciated that the embodiment of FIGS. 13–16 can be combined with one or both of the embodiments discussed hereinabove, if desired.

It will be appreciated that the unique clamping elements provide an improved and reliable apparatus for the removal of staples and/or broken staple pieces. This is because the teeth of typical staple removers are designed to pull a staple from an object by pulling against the crossbar of a staple when the longitudinal axis of the crossbar is generally perpendicular to the direction of pulling. However, when only one prong of a staple is removed, while the other remains in the object, the staple typically bends causing the crossbar to re-align its longitudinal axis parallel to the direction of pulling. This renders the teeth virtually useless in removing the other prong from the object. The unique apparatus and method of the claimed invention overcome this problem as they facilitate the clamping of a partially removed staple, rather than just the surrounding of it as the teeth of the prior art devices do.

The method of the present invention in its preferred form involves providing apparatus that is preferably generally of the above-described type remover of FIGS. 1–10 and/or FIGS. 11 and 12, rotating the teeth of the remover thereby, inserting them between the crossbar of the staple and the object in which the staple is inserted and pulling the staple remover and engaged staple away from the object by camming. If complete removal is not effected, the staple or parts thereof are then positioned between the clamping elements (reference numbers 6 and 48 of FIGS. 1–10 or reference numbers 72 and 73 of FIGS. 11 and 12) of the respective staple remover, the staple remover is then actuated to engage the staple between the clamping elements and the staple remover and staple are pulled away from the object thereby removing the staple from the object. An alternate method involves using the embodiment of FIGS. 13–16 by again removing the staple by inserting the teeth of the respective members of the remover between the crossbar of the staple and the object in which the staple is inserted and pulling the staple remover and engaged staple away from the object, and then, if the staple is not completely removed, the staple or parts thereof can then be positioned between the blocks disposed on the underside of the two members and the staple remover and the staple can be pulled away from the object thereby removing the staple or parts thereof.

While throughout the specification the term "object" has been used to describe the item in which the staple is inserted, it is to be understood that that term refers to numerous items such as a stack or group of papers, block of wood, cork board, plaster board, wall surfaces and the like.

While for convenience of disclosure the staple remover's first and second members have been shown as cooperatively pivotally secured, it will be appreciated that those members may be secured in other movable, nonpivotal manners, such as with a tongue and groove slide for example.

It will be appreciated that the method and associated apparatus of the present invention provide a unique and effective means for the removal of partially, as well as fully, inserted staples from objects.

Whereas particular embodiments of the invention have been described for purposes of illustration, it will be evident to those skilled in the art that numerous variations of the details may be made without departing from the invention as defined in the appended claims.

I claim:

1. A device for removing a staple from an object comprising:

a first member, a second member which is movably secured to said first member, pivot means connecting said first member and said second member, said first member having attached a first clamping element, said second member having a second clamping element for cooperation with said first clamping element in engaging a staple, said first member and said second member each having teeth means adjacent a first end of the longitudinal axis of said staple remover for initiating removal of said staple from the object, and said first clamping element projecting generally outwardly from said first member and said second clamping element projecting generally outwardly from said second member, whereby positioning a portion of a staple intermediate said first and second generally outwardly projecting clamping elements, relatively rotating said first and second generally outwardly projecting clamping elements toward each other to engage said staple between said first and second clamping elements, and moving said staple removing device away from said object will effect removal of said staple from said object.

2. The apparatus of claim 1 including said first and second clamping elements projecting from a second end of the longitudinal axis of said staple remover.

3. The appartus of claim 1 including said first member being pivotally movable with respect to said second member about said pivot means.

4. The apparatus of claim 3 including biasing means engaged with said first member and said second member for urging portions of said members apart.

5. The apparatus of claim 4 including said biasing means being located at the pivotal axis of said first and second members.

6. The apparatus of claim 4 including the pivotal axis of said first and second members being located intermediate said first and second end of the longitudinal axis of said staple remover.

7. The apparatus of claim 4 including said teeth means each being generally wedge-shaped, whereby said teeth means may at least partially remove said staple by camming action.

8. The apparatus of claim 7 including said biasing means being spring means.

9. The apparatus of claim 7 including said biasing means being a resilient compressible material.

10. The apparatus of claim 8 including said spring means being a flat metal spring.

11. The apparatus of claim 7 including said first and second clamping elements having cooperating surfaces that are substantially planar.

12. The apparatus of claim 11 including the planes of said first and second clamping elements being generally parallel when a staple is engaged between said first and second clamping elements.

13. A device for removing a staple from an object comprising:

a first member, a second member which is movably secured to said first member, pivot means connecting said first member and said second member, said first member having attached a first clamping element, said second member having a second clamping element for cooperation with said first clamping element in engaging a staple, said first member and said second member each having teeth means adjacent a first end of the longitudinal axis of said staple remover for initiating removal of said staple from the object, said first clamping element projecting from said first member and said second clamping element projecting from said second member, said first and second clamping elements projecting from a second end of the longitudinal axis of said staple remover, and said second clamping element having a generally angled section and a generally planar section and being attached to said second member, whereby positioning a portion of a staple intermediate said first and second clamping elements, relatively rotating said first and second clamping elements toward each other to engage said staple between said first and second clamping elements, and moving said staple removing device away from said object will effect removal of said staple from said object.

14. The apparatus of claim 13 including said second clamping element having associated with it a stiffening element wherein said stiffening element enhances rigidity of said second clamping element.

15. The apparatus of claim 14 including said stiffening element being attached to said second member and engaging the generally angled section and generally planar section of said second clamping element.

16. The apparatus of claim 14 including said stiffening element being integrally stamped from said angled section of said second clamping element and from said second member.

17. The apparatus of claim 14 including said stiffening element being tabs integrally formed with said second member and engaging said angled section of said second clamping element.

18. The apparatus of claim 14 including said second clamping element having means adaptable to being a tip of a screw driver.

19. The apparatus of claim 14 including said second clamping element adaptable to being a container lid opener.

20. A device for removing a staple from an object comprising:

a first member, a second member which is movably secured to said first member, pivot means connecting said first member and said second member, said first member having attached a first clamping element, said second member having a second clamping element for cooperation with said first clamping element in engaging a staple, said first member and said second member each having teeth means adjacent a first end of the longitudinal axis of said staple remover for initiating removal of said staple from the object, said first clamping element projecting from said first member and said second clamping element projecting from said second member, said first and second clamping elements projecting from a second end of the longitudinal axis of said staple remover, and said first and second clamping elements projecting from said first and second members respectively, at a location intermediate said first and second ends of the longitudinal axis of said staple remover, whereby positioning a portion of a staple intermediate said first and second clamping elements, relatively rotating said first and second clamping elements toward each other to engage said staple between said first and second clamping elements, and moving said staple removing device away from said object will effect removal of said staple from said object.

21. The apparatus of claim 20 including said first and second clamping elements projecting generally transversely from a position intermediate said first end and said pivot means.

* * * * *